US009586333B2

(12) United States Patent
Tanaka et al.

(10) Patent No.: US 9,586,333 B2
(45) Date of Patent: Mar. 7, 2017

(54) SHEET-STAPLING APPARATUS THAT STAPLES CENTER-FOLDED SHEETS BY STAPLE, AND IMAGE-FORMING SYSTEM USING THE SAME

(71) Applicant: KONICA MINOLTA, INC., Chiyoda-ku, Tokyo (JP)

(72) Inventors: Yu Tanaka, Kanagawa-ken (JP); Kazuyuki Fukui, Nagano-ken (JP); Masaaki Ikeda, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 71 days.

(21) Appl. No.: 14/604,270

(22) Filed: Jan. 23, 2015

(65) Prior Publication Data

US 2015/0217474 A1 Aug. 6, 2015

(30) Foreign Application Priority Data

Jan. 31, 2014 (JP) ..... 2014-017282

(51) Int. Cl.
*B27F 7/19* (2006.01)
*B31F 5/00* (2006.01)
(Continued)

(52) U.S. Cl.
CPC ..... *B27F 7/19* (2013.01); *B31F 5/001* (2013.01); *B42C 1/12* (2013.01); *B65H 37/04* (2013.01);
(Continued)

(58) Field of Classification Search
CPC ..... B27F 7/19; B25C 5/0271; B25C 5/0207; B65H 37/04; B65H 2801/27; B31F 5/001; B42C 1/12
(Continued)

(56) References Cited

U.S. PATENT DOCUMENTS 7,607,648 B2 * 10/2009 Trovinger et al. ..... 270/37
8,118,295 B2 * 2/2012 Marcinik et al. ..... 270/58.09
(Continued)

FOREIGN PATENT DOCUMENTS

EP 2839969 A1 2/2015
JP 2005060094 A 3/2005
(Continued)

OTHER PUBLICATIONS

Extended European Search Report dated Jun. 22, 2015, issued in counterpart European Application No. 15152478.2.
(Continued)

*Primary Examiner* — Leslie A Nicholson, III
(74) *Attorney, Agent, or Firm* — Holtz, Holtz & Volek PC

(57) ABSTRACT

A sheet-stapling apparatus mounts a center-folded booklet and staples the booklet at a fold of the booklet by a staple. The sheet-stapling apparatus has a supporting member that mounts the center-folded booklet, a pushing member that pushes the booklet to the supporting member, a stapler that penetrates the staple through the booklet and a clincher that clinches legs of the staple to bind the booklet. The pushing member has a groove that pushes the fold of the booklet and maintains the fold of the booklet at a pushing angle. The supporting member forms the space between the clincher and the booklet.

8 Claims, 6 Drawing Sheets

(51) Int. Cl.

| | |
|---|---|
| ***B42C 1/12*** | (2006.01) |
| ***B65H 37/04*** | (2006.01) |
| ***B65H 45/04*** | (2006.01) |
| *B25C 5/02* | (2006.01) |

(52) U.S. Cl.
CPC ..... *B65H 45/04* (2013.01); *B25C 5/0207* (2013.01); *B25C 5/0271* (2013.01); *B65H 2408/12* (2013.01); *B65H 2801/27* (2013.01)

(58) Field of Classification Search
USPC ..... 270/37, 52.18, 52.26, 58.08; 227/108, 227/155
See application file for complete search history.

(56) References Cited

U.S. PATENT DOCUMENTS

| | | | | |
|---|---|---|---|---|
| 8,146,906 | B2 | 4/2012 | Sugihara | |
| 2006/0091180 | A1* | 5/2006 | Kurabayashi | 227/131 |
| 2010/0252983 | A1 | 10/2010 | Sugihara | |
| 2015/0008635 | A1 | 1/2015 | Tsunoda | |
| 2015/0021845 | A1 | 1/2015 | Kitamura | |

FOREIGN PATENT DOCUMENTS

| | | | |
|---|---|---|---|
| JP | 2010150002 | A | 7/2010 |
| JP | 2010241523 | A | 10/2010 |

OTHER PUBLICATIONS

Japanese Office Action (and English translation thereof) dated Nov. 24, 2015, issued in counterpart Japanese Application No. 2014-017282.

* cited by examiner

RELATED ART

FIG. 4
RELATED ART
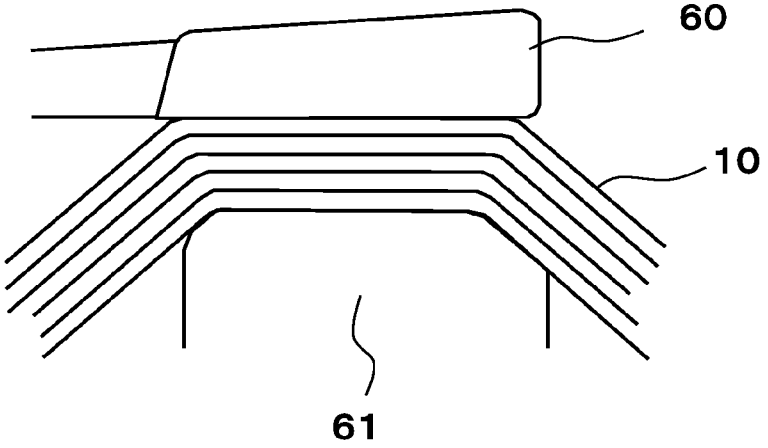
RELATED ART
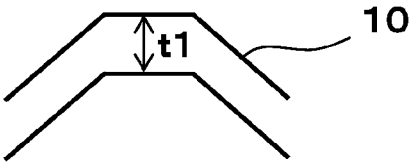
FIG. 5A
RELATED ART
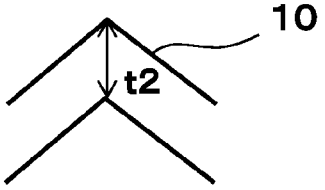
FIG. 5B
RELATED ART
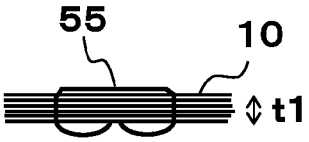
FIG. 6A
RELATED ART
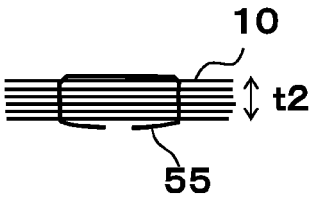
FIG. 6B

SHEET-STAPLING APPARATUS THAT STAPLES CENTER-FOLDED SHEETS BY STAPLE, AND IMAGE-FORMING SYSTEM USING THE SAME

CROSS REFERENCES TO RELATED APPLICATIONS

The present invention contains subject matter related to Japanese Patent Application JP 2014-17282 filed in the Japanese Patent Office on Jan. 31, 2014, the entire contents of which being incorporated herein by reference.

BACKGROUND OF THE INVENTION

Field of the Invention

The present invention relates to a sheet-stapling apparatus that staples center-folded booklet (sheets) by staple(s) and an image-forming system that uses such a sheet-stapling apparatus.

Description of Related Art

A technology to staple a bundle of sheets by a staple has been known in the past. In order that the staple 55 penetrates through a sheet 10P, the staple 55 may have to shear a part of the sheet 10P as shown in FIG. 1A or to rupture a part of sheet 10P with fibers of the sheet 10P being extended as shown in FIG. 1B.

In both cases, the part of the sheet 10P sags by the staple 55 and when exceeding an allowable sagging amount thereof, the part of the sheet 10P opens for the staple 55 to penetrate through the sheet 10P. When increasing number of the sheets 10P, it is difficult for the staple 55 to penetrate through the sheets 10P because an apparent thickness of the sheets 10P is increased by the sag of the sheets 10P.

As shown in FIGS. 2A through 2C, it is known that so-called glasses type clinch in which legs of the staple are curled while the legs of the staple are still curved has performed to form a booklet. In this case, a clincher 50 mounts the booklet 10 in which plural sheets are bundled. Clincher 50 has a narrow cut 51 that allows the legs of the staple 55 to be curled.

A driver 52 drives the staple 55 so that the legs of the staple 55 penetrate through the booklet 10 as shown in FIG. 2A. The driver 52 further drives the staple 55 so that the legs of the staple 55 which penetrates through the booklet 10 are conducted to the narrow cut 51 of the clincher 50 as shown in FIG. 2B and that the legs of the staple 55 are bent inwardly as shown in FIG. 2C.

A sheet-stapling apparatus that staples center-folded booklet (sheets) by staple(s) has been proposed in the past as a sheet finisher for performing any staple processing on the sheets, and the like (see Japanese Patent Application Publication No. 2010-150002). It has been known that it is desirable to align a fold of each of the sheets with a position to be stapled by the staple when the sheet-stapling apparatus forms the booklet by stapling it using the staple(s).

Accordingly, a technology to perform any stapling processing on the center-folded booklet after the booklet is mounted has been known. As shown in FIG. 3A, when the driver drives the staple 55 so that the legs of the staple 55 penetrate through the fold 10*a* of the center-folded booklet 10, an amount of work to be done in order that the booklet 10 sags beyond the allowable sagging amount by the staple 55 is larger than that done by the staple 55 in a case where the legs of the staple 55 penetrate through a flat part of the booklet 10 as shown in FIG. 3B. Accordingly, it is difficult for the staple 55 to penetrate through the booklet without any buckling of the staple. Normally, as shown in FIG. 3C, by allowing the booklet 10 to sag, it may be easy for the staple 55 to penetrate through the booklet 10, which prevents the buckling of the staple 55.

In the past, as shown in FIG. 4, in order to clear up a difficulty for the staple to penetrate through the booklet, the staple processing has been performed after a pushing member 60 has pushed the booklet 10 to a supporting member 61 in order to make a fold of a portion of the booklet to be stapled flat.

SUMMARY OF THE INVENTION

When releasing the fold of the portion of the booklet 10 to which the staple is to be stapled from its pushed flat state as shown in FIG. 5A, the booklet 10 may return to its original center-folded state as shown in FIG. 5B. In this moment, the apparent thickness t1 of the booklet 10 is increased to an apparent thickness t2. When the apparent thickness t1 of the booklet 10 stapled by the staple 55 as shown in FIG. 6A is increased to the apparent thickness t2 shown in FIG. 6B, this may cause forward ends of the legs of the staple 55 to be lifted open. Further, the pushing member 60 pushes the center-folded booklet 10 with large force to the supporting member 61 to make the fold of the portion of the booklet 10 flat, which may deteriorate durability of the booklet and generate considerable loud sound.

On the other hand, when performing the staple processing on the booklet 10 while it is center-folded, it may be possible to prevent the forward ends of the legs of the staple from being lifted open, but this depends on any considerable large force for the legs of the staple to penetrate through the booklet, which may deteriorate penetrability of the staple.

Thus, in the past, the maintenance of penetrability of the staple and the prevention of the forward ends of the legs of the staple from being lifted open have been incompatible with each other.

The present invention addresses the above-described issues by modifying the sheet-stapling apparatus that mounts a center-folded booklet (sheets) and staples the booklet at a fold of the booklet (each of the sheets) by a staple. The present invention provides a sheet-stapling apparatus in which the maintenance of penetrability of the staple and the prevention of the forward ends of the legs of the staple from being lifted open are compatible with each other, and an image-forming system that uses such a sheet-stapling apparatus.

To achieve at least one of the above mentioned objects, a sheet-stapling apparatus reflecting one aspect of the present invention contains a stapler that penetrates the staple through the booklet, a clincher that clinches legs of the staple which penetrates through the booklet, a supporting member that supports the fold of the booklet from below at a first angle while the booklet is mounted so as to be convex upward, and a pushing member that pushes the fold of booklet from above, wherein the pushing member maintains the fold of the booklet at a second angle, which is larger than the first angle, in an operation for the stapler to make the staple penetrate through the booklet and for the clincher to clinch the legs of the staple which penetrates through the booklet, and wherein the supporting member forms a space between the clincher and the booklet.

According to embodiments of the present invention, it is desired to provide the sheet-stapling apparatus wherein the pushing member includes a groove that pushes the fold of the booklet, the groove being configured to have a triangular section in a cross-section which is perpendicular to the fold of the booklet, and the supporting member includes a forward end that supports the fold of the booklet, the forward end being configured to have a triangular section in the cross-section which is perpendicular to the fold of the booklet.

It is further desired to provide the sheet-stapling apparatus wherein the forward end of the supporting member is configured to be movable along a pushing direction of the pushing member and moves to a position in which the supporting member forms the space between the clincher and the booklet in an operation for the groove of the pushing member to push the fold of the booklet.

It is additionally desired to provide the sheet-stapling apparatus wherein a width of supporting position at which the supporting member supports the booklet is wider than a width of pushing position at which the pushing member pushes the booklet.

It is still further desired to provide the sheet-stapling apparatus wherein the groove in the pushing member contains a depth in which a width of the groove in the pushing member along a direction that is perpendicular to the fold of the booklet is narrower than a width of supporting position at which the supporting member supports the booklet.

Other objects and attainments of the present invention will be become apparent to those skilled in the art upon a reading of the following detailed description when taken in conjunction with the drawing.

BRIEF DESCRIPTION OF THE DRAWINGS

FIG. 4 is a schematic illustration that illustrates a configuration example of a related sheet-stapling apparatus;

FIG. 5A is a diagram showing a related stapling method of stapling a booklet;

FIG. 5B is a diagram showing the related stapling method of stapling the booklet;

FIG. 6A is a diagram showing the related stapling method of stapling the booklet;

FIG. 6B is a diagram showing the related stapling method of stapling the booklet;

DESCRIPTION OF THE PREFERRED EMBODIMENTS

The following will describe embodiments of a sheet-stapling apparatus and an image forming system using the same according to the present invention with reference to the drawings. Such description does not limit the technical scope, meaning of terms and the like in Claims.

<Configuration Examples of Sheet-Stapling Apparatus and Image-Forming System According to Embodiments of Present Invention>

Figure 7:
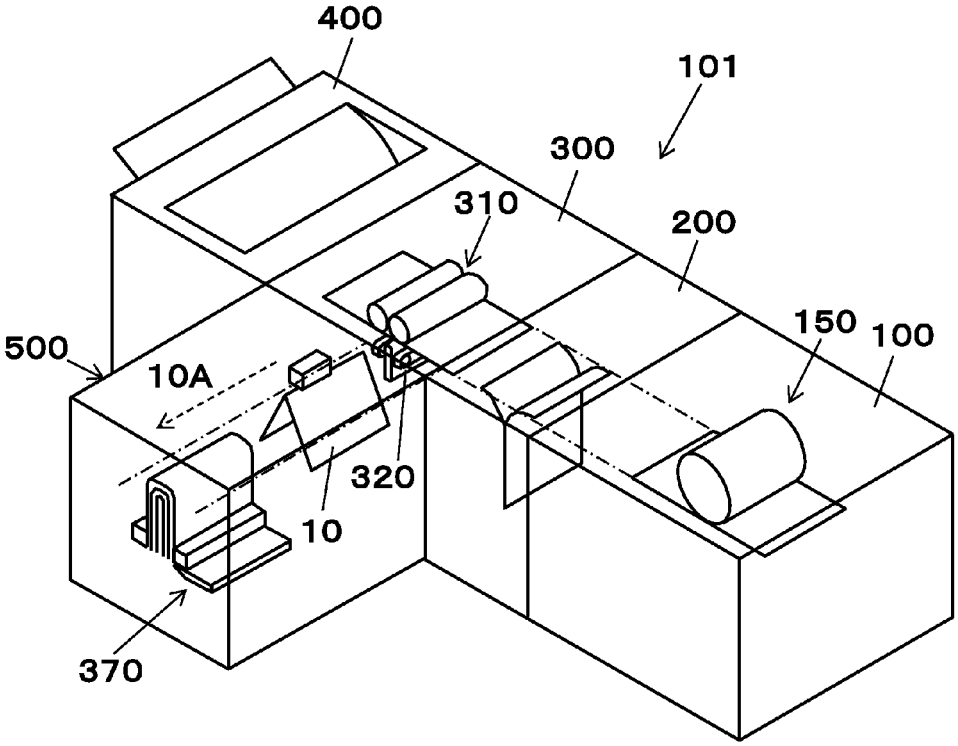
FIG. 7 is a perspective view of an image-forming system including a sheet-stapling apparatus according to an embodiment of the invention for showing a configuration example of the image-forming system.

An image-forming system 101, as shown in FIG. 7, according to the embodiment of this invention contains a sheet-stapling apparatus 500 according to the embodiment of this invention and an image-forming apparatus 100 that forms an image on a sheet and discharges it. The image-forming system 101 also contains an intermediate transportation apparatus 200, a saddle-stitching apparatus 300 and a side-stitching apparatus 400.

The image-forming apparatus 100 forms the image on the sheet. For example, the image-forming apparatus 100 contains a sheet-transporting portion that brings a sheet out of a paper tray to transport it, a developing portion that develops a toner image based on bit map data on a primary transfer member such as a transfer roller, the primary transfer portion that transfers the toner image developed onto the primary transfer member to a secondary transfer member such as a transfer drum 150, the secondary transfer portion that transfers the toner image transferred to the secondary transfer member to a sheet transported by the sheet-transporting portion, a fixing portion that fixes the transferred toner image on the sheet and a discharging portion that discharges the sheet fixed by the fixing portion. The image-forming apparatus 100 transports the sheet on which the image has been formed to the intermediate transportation apparatus 200.

The intermediate transportation apparatus 200 temporarily holds the sheet and previously folds the sheet and/or trims the sheet. The intermediate transportation apparatus 200 contains a stacker that transports sheets fed from the image-forming apparatus 100 downward and stops the transportation of the sheets to stand for while they are held with their surfaces being almost faced to a vertical direction, an aligning portion that aligns positions of the held sheets, a creaser that forms a fold on the aligned sheets by folding them, and a slitter that trims any margin in each of the sheets while transporting the sheets on which the fold is formed.

The intermediate transportation apparatus 200 aligns the sheets transported from the image-forming apparatus 100 by the aligning portion while the stacker stops the transportation of the sheets, forms the fold by the creaser, and trims any margin in each of the sheets by the slitter while transporting the sheets on which the fold is formed. The intermediate transportation apparatus 200 then transports the sheets in which the margin has been trimmed by the slitter to the saddle-stitching apparatus 300.

The saddle-stitching apparatus 300 performs as a sheet-finisher a center-fold processing for center-folding the sheet (by two), a saddle-stitching processing to stack a predetermined numbers of center-folded sheets and bind them so that the saddle-stitched booklet is formed, an edge-cutting processing to cut the edge of the booklet and the like.

For example, the saddle-stitching apparatus 300 contains a center-folding portion 310 that center-folds each of the sheets transported from the intermediate transportation apparatus 200, a transporting mechanism 320 that transports each of the sheets center-folded by the center-folding portion 310 toward a direction 10A extending along the fold of each of the sheets, a sheet-stapling apparatus 500 that staples the booklet 10 to form the saddle-stitched booklet after the sheets transported from the transporting mechanism 320 are stacked to form the booklet 10, and a cutting portion 370 that cuts the edge of the saddle-stitched booklet 10.

Figure 1A:
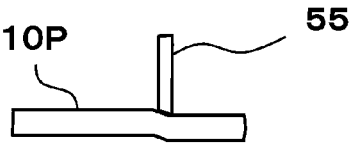
FIG. 1A RELATED ART
FIG. 1A is a diagram showing a penetration principle of staple.
Figure 1B:
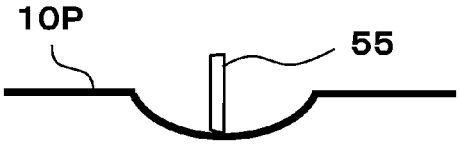
FIG. 1B RELATED ART
FIG. 1B is a diagram showing another penetration principle of staple.
Figure 2A:
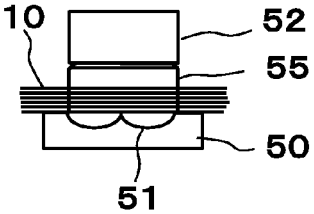
FIG. 2A RELATED ART
FIG. 2A is a diagram showing a related stapling example of a booklet by a staple.
Figure 2B:
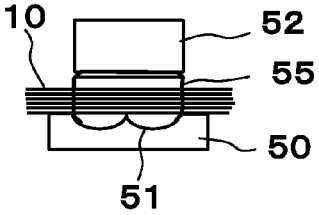
FIG. 2B RELATED ART
FIG. 2B is a diagram showing the related stapling example of the booklet by the staple.
Figure 2C:
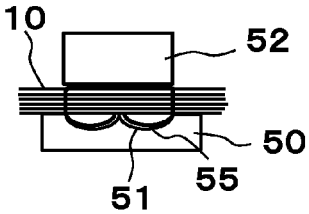
FIG. 2C RELATED ART
FIG. 2C is a diagram showing the related stapling example of the booklet by the staple.
Figure 8:
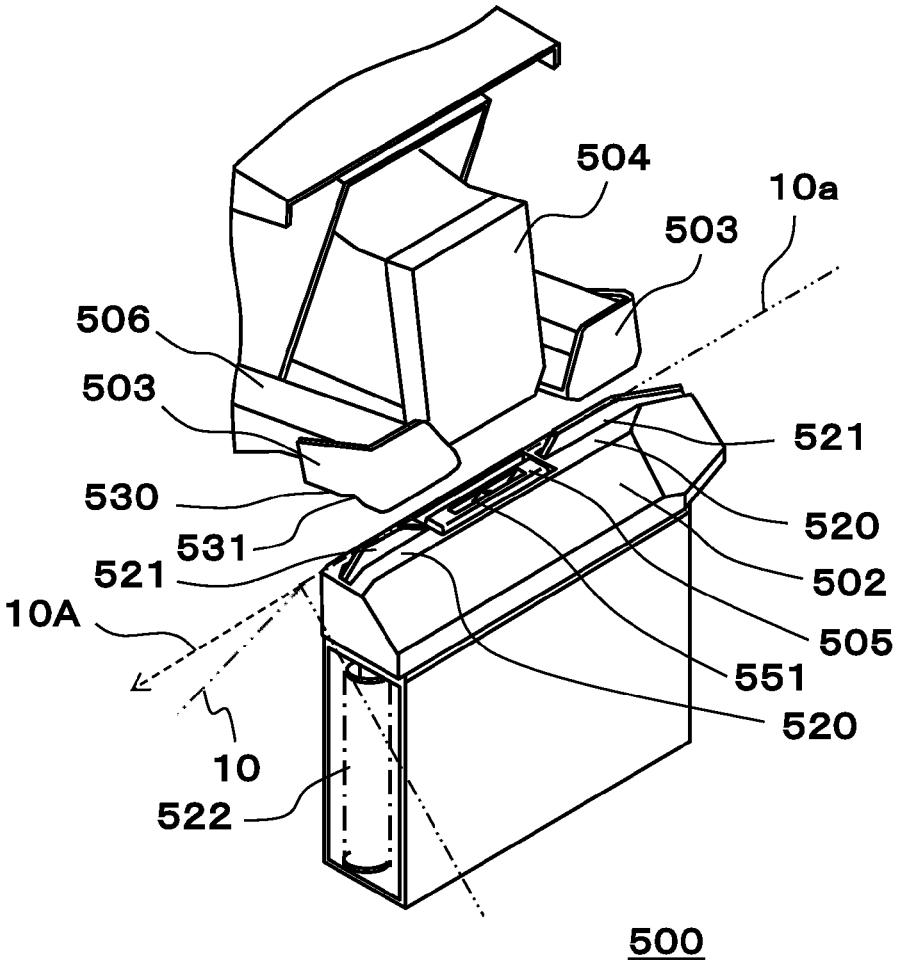
FIG. 8 is a perspective view of the sheet-stapling apparatus according to the embodiment of the invention for showing a configuration example of an important portion of the sheet-stapling apparatus.
Figure 9:
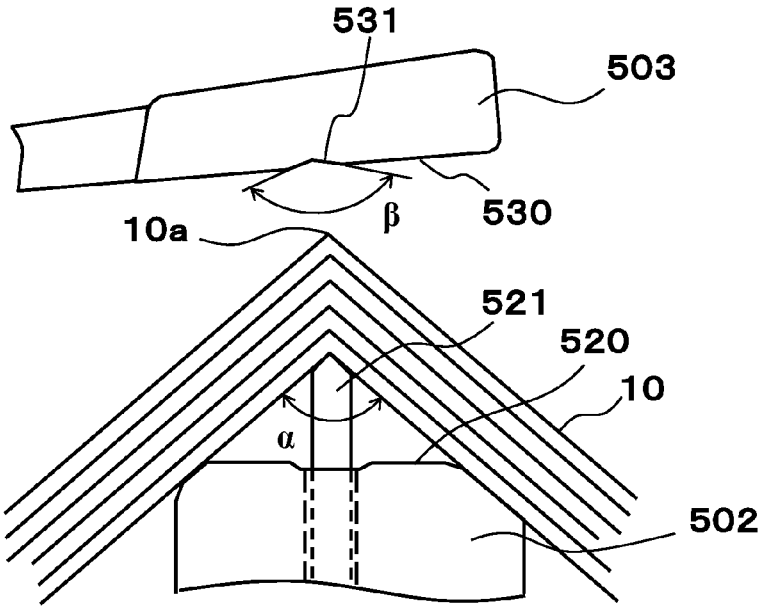
FIG. 9 is a side view of the sheet-stapling apparatus according to the embodiment of the invention for showing a configuration example of an important portion of the sheet-stapling apparatus.
Figure 10:
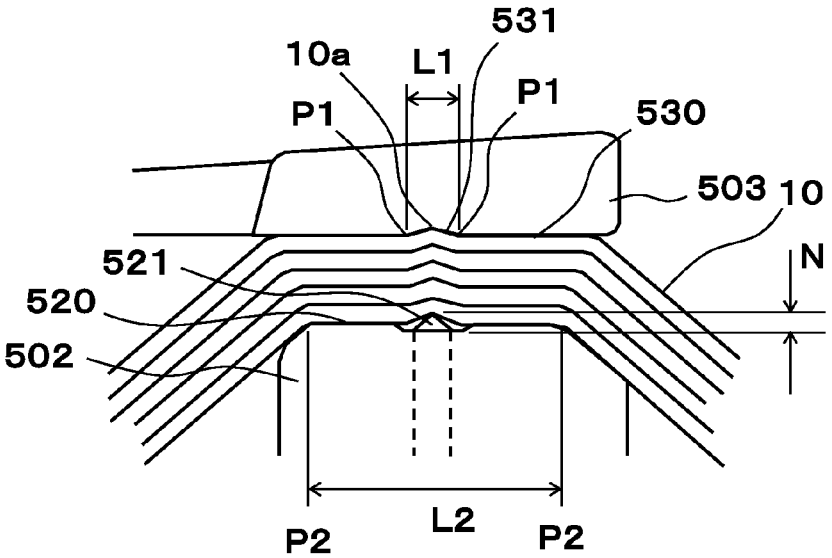
FIG. 10 is a side view of the sheet-stapling apparatus according to the embodiment of the invention for showing the configuration example of the important portion of the sheet-stapling apparatus.

The following will describe the sheet-stapling apparatus 500 according to the embodiment of the invention more in detail with reference to FIGS. 8 through 10. In the sheet-stapling apparatus 500 according to this embodiment, the booklet 10 is mounted so as to be a convex upwardly. The sheet-stapling apparatus 500 contains a supporting member 502 on which the center-folded booklet 10 is mounted so as to be a convex upwardly and pushing members 503, 503 each pushing the booklet 10 to the supporting member 502. The sheet-stapling apparatus 500 also contains a stapler 504 that penetrates the staple through the booklet 10 and a clincher 505 that clinches the legs of the staple to bind the booklet 10. The clincher 505 has curved narrow cut 551, as show in FIGS. 2A through 2C, to form the related clinch, namely, so-called glasses type clinch.

In the sheet-stapling apparatus 500, the supporting member 502 is positioned around the clincher 505 along the direction 10A of the fold 10*a* of the booklet 10 mounted on the supporting member 502. The stapler 504 is positioned so as to face the clincher 505. The pushing members 503, 503 are positioned at both sides of the stapler 504 so as to face the supporting member 502.

The sheet-stapling apparatus 500 contains a driving mechanism 506. The driving mechanism 506 drives the stapler 504 to approach the clincher 505 or move away from the clincher 505 and drives the pushing members 503, 503 to approach the supporting member 502 or move away from the supporting member 502 together with the stapler 504.

The supporting member 502 contains a supporting surface 520 on a side that is opposite to the pushing members 503, 503, namely, an upper surface of the supporting member 502 in this embodiment. The supporting surface 520 supports the booklet 10 when it is pushed by the pushing members 503, 503. The supporting member 502 also contains supporting forward ends 521, 521 that support the fold 10*a* of the booklet 10.

The supporting forward ends 521, 521 are positioned ahead and behind the clincher 505 along the direction 10A of the fold 10*a* of the booklet 10. The pushing members 503, 503 are configured so as to be movable along a vertical direction in which they push the booklet 10. Springs 522 urge the supporting forward ends 521, 521 upwardly to project them out of the supporting surface 520.

Each of the supporting forward ends 521, 521 has a shape corresponding to the fold 10*a* of the booklet 10, namely, a triangular section in this embodiment. Each of the supporting forward ends 521, 521 has the triangular section having an angle corresponding to a center-fold angle α which is included by both leaves, folded in half, of the booklet 10 at the fold 10*a* when the booklet 10 is mounted on the supporting member 502 (see FIG. 9). The supporting forward ends 521, 521 support the fold 10*a* of the booklet 10, which is mounted so as to be a convex upwardly to the lower portion thereof, from below. Supporting the fold 10*a* of the booklet 10 from below enables the fold 10*a* to be aligned to the stapler 504 by weight of the booklet 10 itself.

Each of the pushing members 503, 503 contains a pushing surface 530 that pushes the booklet 10. The pushing surface 530 is configured to have a surface corresponding to the supporting surface 520 of the supporting member 502 at a side of each of the pushing members 503, 503, which is opposite to the supporting member 502, namely, a lower surface of each of the pushing members 503, 503 in this embodiment. The pushing surface 530 has a pushing groove 531 that pushes the fold 10*a* of the booklet 10.

The pushing groove 531 is formed of two inclined surfaces which are inwardly inclined from the pushing surface 530 so as to form a triangular section. The pushing groove 531 is formed so as to be opposed to each of the supporting forward ends 521, 521. The pushing grooves 531, 531 push the fold 10*a* of the booklet 10 which is supported by each of the supporting forward ends 521, 521. Each of the pushing grooves 531, 531 has a pushing angle β which is formed by inclined planes of the pushing groove 531. This pushing angle β is larger than the center-fold angle α of the each of the supporting forward ends 521, 521. Accordingly, an angle of the fold 10*a* of the booklet 10 is fixed at a timing of penetrating the staple through the booklet 10.

In this embodiment, the center-fold angle α, which is included by both leaves of the booklet 10 at the fold 10*a* when the booklet 10 is mounted on the supporting member 502, namely, an angle of the triangular section of the each of the supporting forward ends 521, 521, is set to be about 90 degrees. On the other hand, the pushing angle β which is included by the opposite inclined planes of the pushing groove 531 is set to be about 140 through 160 degrees.

In an operation to push the booklet 10 by the pushing surface 530 of each of the pushing members 503, 503, the edges P1, P1 of the pushing grove 531 become points of application while the side ends P2, P2 of the supporting surface 520 of the supporting member 502 become fulcrums. The width L1 of the pushing groove 531 along a direction which is perpendicular to the direction 10A along the fold 10*a* of the booklet 10 is configured so as to be narrower than a width L2 of the supporting surface 520 of the supporting member 502 so that a distance between the side ends P2, P2 of the supporting surface 520, namely, a distance between the fulcrums is longer than a distance between the edges P1, P1 of the pushing grove 531, namely, a distance between the points of application. Further, a depth of the pushing groove 531 is set so that the width L2 of the supporting surface 520 is longer than the width L1 of the pushing groove 531.

<Operation Examples of Sheet-Staple Apparatus and Image-Forming System According to these Embodiments>

The following will describe operations to staple the booklet 10 in the sheet-stapling apparatus 500 with reference to the drawings.

In the image-forming system 101, the saddle-stitching apparatus 300 performs a center-fold processing to form the booklet 10 and transports it to the sheet-stapling apparatus 500 in which the booklet 10 is mounted on the supporting member 502. The supporting forward ends 521, 521 then support the fold 10*a* of the booklet 10 mounted on the supporting member 502, as shown in FIG. 9.

In the sheet-stapling apparatus 500, the driving mechanism 506 drives the pushing members 503, 503 to approach the supporting member 502. The pushing members 503, 503 then push the booklet 10 mounted on the supporting member 502. The pushing members 503, 503 and the supporting member 502 nip booklet 10.

When the pushing members 503, 503 push the booklet 10, the pushing grooves 531, 531 push the fold 10*a* of the booklet 10. When the pushing grooves 531, 531 push the fold 10*a* of the booklet 10, the center-fold angle α of the booklet 10 at the fold 10*a* spreads corresponding to the pushing angle β of each of the pushing grooves 531, 531. The supporting forward ends 521, 521, which support the fold 10*a* of the booklet 10, are then pushed down against force by the springs 522.

The pushing surfaces 530, 530 of the pushing members 503, 503 push the booklet 10 to the supporting surface 520 of the supporting member 520. The pushing members 503, 503 and the supporting member 502 then nip booklet 10. When the pushing members 503, 503 and the supporting member 502 nip booklet 10, the supporting forward ends 521, 521 of the supporting member 502 project from the supporting surface 520 with it corresponding to a groove shape of each of the pushing grooves 531, 531 of the pushing members 503, 503, as shown in FIG. 10.

This enables the booklet to keep the fold 10*a* even after the pushing members 503, 503 push the booklet 10 to the supporting surface 520 of the supporting member 502. This also enables the center-fold angle α of the booklet 10 at the fold 10*a* to spread corresponding to the pushing angle β of each of the pushing grooves 531, 531.

Figure 11:
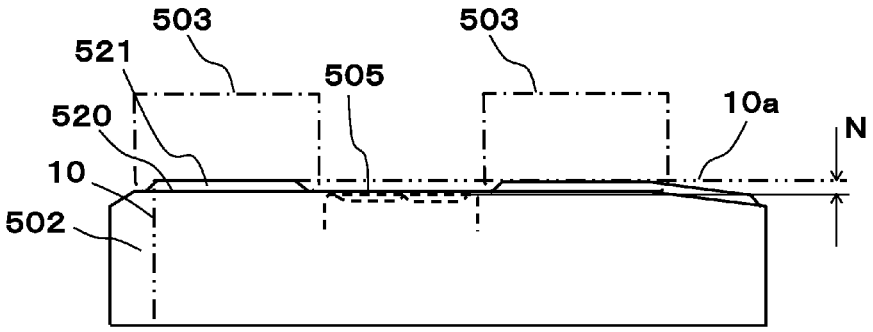
FIG. 11 is a diagram showing an operation example of the sheet-stapling apparatus according to the embodiment of the invention.

As shown in FIG. 11, the supporting forward ends 521, 521 support the fold 10*a* of the booklet 10 along the fold 10*a* at portions of the supporting member 502 on either side of the clincher 505. Thus, a predetermined space N is formed between the fold 10*a* of the booklet 10 and the clincher 505 so as to correspond to the groove shape of each of the pushing grooves 531, 531 of the pushing members 503, 503.

In the booklet-holding state shown in FIG. 10, the driving mechanism 506 drives the stapler 504 to approach the clincher 505 together with the pushing members 503, 503. The stapler 504 and the clincher 505 then nip the booklet 10. The stapler 504 drives the staple so as to penetrate through the booklet 10. The clincher 505 clinches the legs of the staple which penetrates through the booklet 10. This enables the booklet 10 to be stapled. The driving mechanism 506 drives the pushing members 503, 503 to move away from the supporting member 502 and drives the stapler 504 to move away from the clincher 505. This completes the staple processing.

Figure 3A:
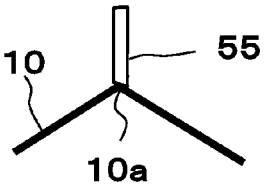
FIG. 3A RELATED ART
FIG. 3A is a diagram showing a related case of forming the booklet as a comparison example.
Figure 3B:
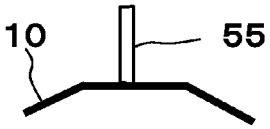
FIG. 3B RELATED ART
FIG. 3B is a diagram showing the related case of forming the booklet as the comparison example.
Figure 3C:
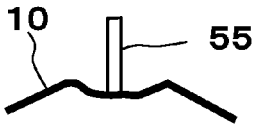
FIG. 3C is a diagram showing the related case of forming the booklet as the comparison example.

Forming the space N between the fold 10*a* of the booklet 10 and the clincher 505 allows the booklet 10 to be flexible, as shown in FIG. 3C, when the staple penetrates through the booklet 10 in the operation of stapling the booklet 10, which makes it easier for the staple to penetrate through the booklet. Accordingly, it is also possible to prevent any buckling of the staple. Although the pushed booklet 10 returns to its original shape after the pushing pressure by the pushing members 503, 503 is released, the apparent thickness of the booklet does not increase in this embodiment as compared with a case shown in FIGS. 5A and 5B where the stapling process is performed on the booklet while the fold is pushed to be made flat because each of the pushing grooves 531, 531 of the pushing members 503, 503 has the pushing angle β in this embodiment. Thus, it is possible to prevent the forward ends of the legs of the staple from being lifted open.

When the pushing groove 531 of each of the pushing members 503, 503 push the booklet 10, a distance between the supporting points P2, P2 for supporting the booklet in the supporting member 502 is longer than a distance between the pushing points P1, P1 for pushing the booklet 10 in each of the pushing members 503, 503. The distance between the supporting points P2, P2 is a width of supporting position at which the supporting member supports the booklet. The distance between pushing points P1, P1 is a width of pushing position at which the pushing member pushes the booklet. These positional relationships enable any flattening force for flattening the booklet 10 by pushing the booklet 10 to the supporting surface 520 with the pushing surface 530 to decrease so that the fold 10*a* remains in the booklet 10.

Holding the booklet 10 in a state that the center-fold angle α of the booklet 10 at the fold 10*a* is spread corresponding to the pushing angle β of each of the pushing grooves 531, 531 allows the sheet-stapling apparatus 500 according to this embodiment to nip the booklet 10 with the fold 10*a* remaining in the booklet 10. Further, the sheet-stapling apparatus 500 according to this embodiment can decrease staple penetration force which may be required when penetrating the staple to the booklet 10. Additionally, since the pushing grooves 531, 531 hold the fold 10*a* of the booklet 10, the sheet-stapling apparatus 500 according to this embodiment can prevent any displacement of the booklet 10 to a direction that is perpendicular to the fold 10*a* of the booklet 10. Thus, it is also possible to prevent any positional misalignment between the fold 10*a* of the booklet 10 and a stapled position of the booklet through which the staple penetrates. Accordingly, the sheet-stapling apparatus 500 according to this embodiment is compatible with the maintenance of penetrability of the staple in preventing any buckling and the accuracy of stapled position of the booklet.

Figure 12:
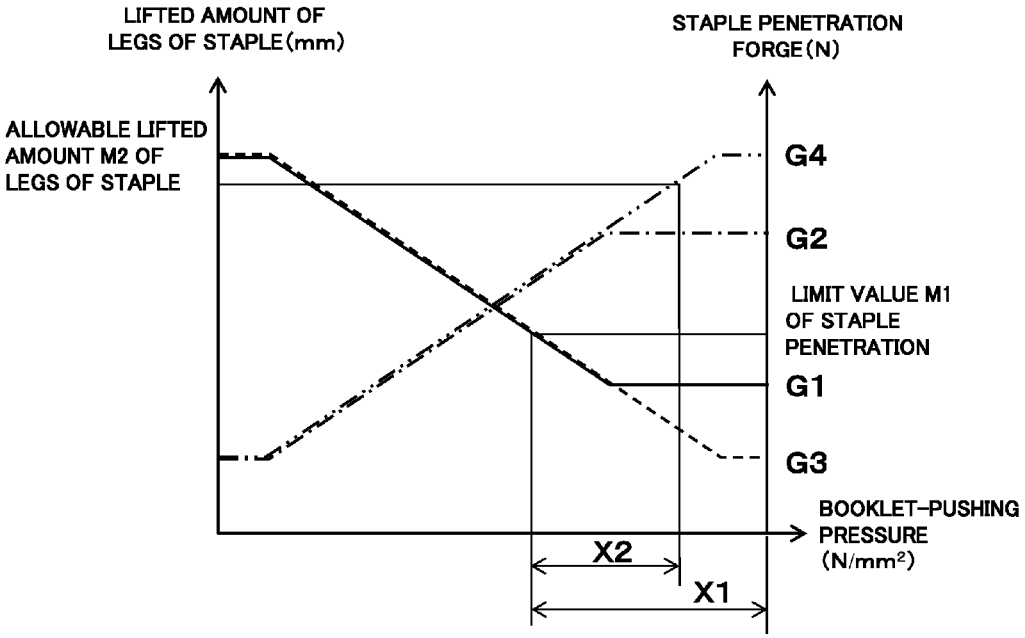
FIG. 12 is a graph showing a relationship between a lifted amount of the legs of staple and staple penetration force.

FIG. 12 conceptually shows a relationship between a lifted amount of the legs of staple and staple penetration force in connection with booklet-pushing pressure. In FIG. 12, a solid line indicates the staple penetration force G1 required in the configuration of this embodiment and an alternate long and short dash line indicates a lifted amount of legs of staple G2 generated in this embodiment. A dotted line indicates the staple penetration force G3 required in the related configuration and a long dashed double-short dashed line indicates a lifted amount of legs of staple G4 generated in the related configuration. A limit value M1 of the staple penetration force is referred to as an upper limit value of the staple penetration force by which the staple can penetrate the booklet without generating any buckling in the staple. In other words, when the staple penetration force exceeds the limit value M1 of the staple penetration force, the buckling occurs in the staple. An allowable lifted amount M2 of legs of staple is referred to as an upper limit value of the allowable lifted amount of legs of staple when forward ends of the legs of the staple are lifted open after the booklet is bound. In other words, when the lifted amount of legs of staple exceeds the allowable lifted amount M2 of legs of staple, forward ends of the legs of the staple are lifted open.

X2 indicates a range of booklet-pushing pressure in which the decrease in the staple penetration force and the decrease in the lifted amount of the forward ends of the legs of the staple are compatible in the related configuration. In other words, X2 indicates a range of booklet-pushing pressure in which the staple penetration force G3 does not exceed the limit value M1 of the staple penetration force and the lifted amount of legs of staple G4 does not exceed the allowable lifted amount M2 of legs of staple. On the other hand, in this embodiment, X1 indicates a range of booklet-pushing pressure in which the decrease in the staple penetration force and the decrease in the lifted amount of the forward ends of the legs of the staple are compatible. In other words, X1 indicates a range of booklet-pushing pressure in which the staple penetration force G1 does not exceed the limit value M1 of the staple penetration force and the lifted amount of legs of staple G2 does not exceed the allowable lifted amount M2 of legs of staple.

In the related configuration, the range of booklet-pushing pressure X2 in which the decrease in the staple penetration force and the decrease in the lifted amount of the forward ends of the legs of the staple are compatible is narrower. However, in this embodiment, the range of booklet-pushing pressure X1 in which the decrease in the staple penetration force and the decrease in the lifted amount of the forward ends of the legs of the staple are compatible is broader than the above-mentioned range of booklet-pushing pressure X2.

This allows the maintenance of penetrability of the staple by the decrease in the staple penetration force and the prevention of the forward ends of the legs of the staple from being lifted open to be compatible. Thus, even when the booklet-pushing pressure for pushing the booklet 10 is low, it is possible to penetrate the staple to the booklet by this pressure, to improve the durability of the booklet and to prevent any loud sound from generating in the sheet-stapling apparatus.

The following table 1 indicates suitable conditions of the staple penetration property, lifted open of the forward ends of the legs of the staple and the accuracy of stapled position of the booklet in connection with the pushing angle β in each of the pushing grooves 531, 531 of the pushing members 503, 503, the space N between the fold 10*a* of the booklet 10 and the clincher 505 and relationship between the distance between the points of application P1, P1 for pushing the booklet 10 in each of the pushing members 503, 503 and the distance between the fulcrums P2, P2 for supporting the booklet in the supporting member 502.

TABLE 1

| | Space N | Pushing Angle β | Distance L1 between Points of Application P1, P1 and Distance L2 between Fulcrums P2, P2 |
|---|---|---|---|
| Staple Penetration Property | Required | 140 degrees or more | L1 < L2 |
| Lifted Open of Forward Ends of Legs of Staple | Required | 160 degrees or less | |
| Accuracy of Stapled Position of Booklet | | Less than 180 degrees | |

As shown in Table 1, the inventors found out that when the space N was formed between the fold 10*a* of the booklet 10 and the clincher 505, the distance L2 between the fulcrums P2, P2 was longer than the distance L1 between points of application P1, P1, and the pushing angle β in each of the pushing grooves 531, 531 of the pushing members 503, 503 was 140 degree or more, the staple penetration force could decrease.

They also found out that when the space N was formed between the fold 10*a* of the booklet 10 and the clincher 505 and the pushing angle β in each of the pushing grooves 531, 531 of the pushing members 503, 503 was 160 degree or less, the lifted amount of the legs of the staple could decrease. They further found out that the relationship between the distance L2 between the fulcrums P2, P2 and the distance L1 between points of application P1, P1 had not any influence on the lifted amount of the legs of the staple.

They additionally found out that the accuracy of the stapled position of booklet was good when the pushing angle β in each of the pushing grooves 531, 531 of the pushing members 503, 503 was less than 180 degrees. Accordingly, they found out that it was preferable that the pushing angle β in each of the pushing grooves 531, 531 of the pushing members 503, 503 was 140 degrees or more and 160 degrees or less.

The terms and expressions which have been employed in the foregoing description are used therein as terms of description and not of limitation, and these are no intention, in the use of such terms and expressions, of excluding equivalent of the features shown and described or portions thereof, it being recognized that the scope of the invention is defined and limited only by the claims.

What is claimed is:

1. A sheet-stapling apparatus that mounts a center-folded booklet and staples the booklet at a fold of the booklet by a staple, the apparatus comprising:

a stapler that penetrates the staple through the booklet;

a clincher that clinches legs of the staple which penetrates through the booklet;

a supporting member that supports the fold of the booklet from below at a first angle of the fold of the booklet while the booklet is mounted thereon such that the fold of the booklet is convex upward; and a pushing member that, while the supporting member supports the fold of the booklet from below at the first angle of the fold of the booklet, pushes the fold of booklet from above, wherein the pushing member maintains the fold of the booklet at a second angle, which is larger than the first angle, in an operation for the stapler to make the staple penetrate through the booklet and for the clincher to clinch the legs of the staple which penetrates through the booklet, and wherein the supporting member forms a space between the clincher and the booklet.

2. The sheet-stapling apparatus according to claim 1, wherein the pushing member includes a groove that pushes the fold of the booklet, the groove being configured to have a triangular section in a cross-section which is perpendicular to the fold of the booklet, and the supporting member includes a forward end that supports the fold of the booklet, the forward end being configured to have a triangular section in the cross-section which is perpendicular to the fold of the booklet.

3. The sheet-stapling apparatus according to claim 2, wherein the forward end of the supporting member is configured to be movable along a pushing direction of the pushing member such that a protected amount of the forward end of the supporting member is variable, the protected amount being an amount by which the forward end of the supporting member protects from a surface on which the clincher is positioned, and wherein in an operation in which the groove of the pushing member pushes the fold of the booklet, the forward end of the supporting member moves to a position at which the protected amount thereof is an amount such that the supporting member forms and maintains the space between the clincher and the booklet when the pushing member pushes the fold of the booklet.

4. The sheet-stapling apparatus according to claim 1, wherein a width of a supporting position at which the supporting member supports the booklet is wider than a width of a pushing position at which the pushing member pushes the booklet.

5. The sheet-stapling apparatus according to claim 3, wherein the groove in the pushing member has a depth at which a width of the groove in the pushing member along a direction that is perpendicular to the fold of the booklet is narrower than a width of a supporting position at which the supporting member supports the booklet.

6. An image-forming system including an image forming apparatus that forms an image on sheets which consist of a center-folded booklet and a sheet-stapling apparatus that mounts the center-folded booklet and staples the booklet at a fold of the booklet by a staple, the sheet-stapling apparatus comprising:

a stapler that penetrates the staple through the booklet;

a clincher that clinches legs of the staple which penetrates through the booklet;

a supporting member that supports the fold of the booklet from below at a first angle of the fold of the booklet while the booklet is mounted thereon such that the fold of the booklet is convex upward; and a pushing member that, while the supporting member supports the fold of the booklet from below at the first angle of the fold of the booklet, pushes the fold of booklet from above, wherein the pushing member maintains the fold of the booklet at a second angle, which is larger than the first angle, in an operation for the stapler to make the staple penetrate through the booklet and for the clincher to clinch the legs of the staple which penetrates through the booklet, and wherein the supporting member forms a space between the clincher and the booklet.

7. The image-forming system according to claim 6, wherein the pushing member includes a groove that pushes the fold of the booklet, the groove being configured to have a triangular section in a cross-section which is perpendicular to the fold of the booklet, and the supporting member includes a forward end that supports the fold of the booklet, the forward end being configured to have a triangular section in the cross-section which is perpendicular to the fold of the booklet.

8. The image-forming system according to claim 7, wherein the forward end of the supporting member is configured to be movable along a pushing direction of the pushing member such that a projected amount of the forward end of the supporting member is variable, the projected amount being an amount by which the forward end of the supporting member projects from a surface on which the clincher is positioned, and wherein in an operation in which the groove of the pushing member pushes the fold of the booklet, the forward end of the supporting member moves to a position at which the projected amount thereof is an amount such that the supporting member forms and maintains the space between the clincher and the booklet when the pushing member pushes the fold of the booklet.

* * * * *